US008699735B2

(12) United States Patent
Kral et al.

(10) Patent No.: US 8,699,735 B2
(45) Date of Patent: Apr. 15, 2014

(54) IDENTIFICATION ELEMENT FOR A HEARING DEVICE UNIT

(75) Inventors: Holger Kral, Fürth (DE); Frank Wagner, Hemhofen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1253 days.

(21) Appl. No.: 11/893,518

(22) Filed: Aug. 16, 2007

(65) Prior Publication Data

US 2008/0044047 A1 Feb. 21, 2008

(30) Foreign Application Priority Data

Aug. 16, 2006 (DE) ..... 10 2006 038 065

(51) Int. Cl.
*H04R 25/00* (2006.01)

(52) U.S. Cl.
USPC ..... 381/322

(58) Field of Classification Search
USPC ..... 381/312, 314, 315, 322, 23.1
See application file for complete search history.

(56) References Cited

U.S. PATENT DOCUMENTS

| | | | | |
|---|---|---|---|---|
| 6,556,686 | B1 | 4/2003 | Weidner | |
| 6,731,770 | B1 | 5/2004 | Vonlanthen | |
| 2002/0164042 | A1 | 11/2002 | Vonlanthen | |
| 2004/0042629 | A1 | 3/2004 | Mellone | |
| 2005/0008175 | A1 * | 1/2005 | Hagen et al. | 381/314 |

FOREIGN PATENT DOCUMENTS

| | | | |
|---|---|---|---|
| DE | 19916900 | C1 | 9/2000 |
| EP | 1562399 | A2 * | 8/2005 |
| WO | WO 9966778 | A2 | 12/1999 |
| WO | WO 2004073351 | A1 | 8/2004 |

* cited by examiner

*Primary Examiner* — Jeffrey Donels
(74) *Attorney, Agent, or Firm* — Laurence A. Greenberg; Werner H. Stemer; Ralph E. Locher

(57) ABSTRACT

The invention relates to an identification element for a hearing device unit of a hearing device system, with the hearing device system comprising a hearing device unit provided for the left ear of a wearer and a hearing device unit provided for the right ear of a wearer, with the identification element) visibly identifying the hearing device unit from the outside, characterized in that the identification element visibly identifies the hearing device unit as a left or right hearing device unit and comprising a means for assigning a function as a left or right hearing device unit to a signal processing facility of the hearing device unit. The assigning means can be mechanical, electrical and/or magnetic assigning means.

5 Claims, 1 Drawing Sheet

IDENTIFICATION ELEMENT FOR A HEARING DEVICE UNIT

CROSS REFERENCE TO RELATED APPLICATIONS

This application claims priority of German application No. 10 2006 038 065.7 filed Aug. 16, 2006, which is incorporated by reference herein in its entirety.

FIELD OF THE INVENTION

The invention relates to an identification element for a bearing device unit of a hearing device system, which comprises a hearing device unit provided for the left ear of a wearer and a hearing device unit provided for the right ear of the wearer, with the identification element visibly identifying the hearing device unit from the outside.

BACKGROUND OF THE INVENTION

With hearing device systems having dual coverage, in other words a hearing device for the left ear of a wearer and a hearing device for the right ear of a wearer, it is possible to adjust the left and the right device individually to the requirements of the wearer in each instance. To this end, an item of information must be assigned to the respective hearing device unit to determine whether it concerns the left or the right hearing device unit. The left or right hearing device unit was previously connected to a cable, and the hearing device acoustician was then able to assign a function as a left and/or right hearing device unit to the respective hearing device unit by way of a programming device. To enable the wearer to be able to make a distinction between the two hearing device units, it is usual to provide said hearing device units with an identification element which is visible from the outside, e.g. a colored name plate, with a blue name plate standing for the left hearing device unit for instance and a red name plate standing for the right hearing device unit.

In the case of wirelessly programmable devices, the difficulty arises, during the wireless sending of programming information, of both hearing device units being able to receive, and not being assigned, the information relating to which is now the left hearing device unit and which is now the right hearing device unit.

The publication DE 199 16 900 C1 discloses the manner in which specific characteristics or features of the hearing device are to be closed or released by means of a hardware key or a software key.

SUMMARY OF THE INVENTION

The object of the present invention is to create a hearing device system with an associated identification element, with a function as a left or right hearing device unit being assigned to the hearing device units of the hearing device system by way of the identification element. In accordance with the invention, this is achieved by an identification element and a hearing device system as claimed in the independent claims. Preferred developments of the invention are contained in the subclaims. The invention is based on the idea that the identification element comprises a feature, which can be used in a signal-specific manner for the signal processing facility of a hearing device unit.

The invention relates to an identification element for a hearing device unit of a hearing device system, with the hearing device system comprising a hearing device unit provided for the left ear of a wearer and a hearing device unit provided for the right ear of a wearer, with the identification element visibly identifying the hearing device unit from the outside, which is characterized in that the identification element visibly identifies the hearing device unit as a left or right hearing device unit and comprising a means for assigning a function as a left or right hearing device unit to a signal processing facility of the hearing device unit.

The means preferably comprises electrical and/or mechanical and/or magnetic assigning means for assigning a function as a left or right hearing device unit. The means preferably comprises an electrotechnical component for assigning a function as a left or right hearing device unit. In particular, it is preferred that a conductor path in the hearing device unit is selectively not electrically connected and/or is electrically connected by means of the means for assigning a function as a left or right hearing device unit. It is also conceivable that a first conductor path for the one hearing device is connected for assigning the function as a left or right hearing device and a second conductor is connected for the other hearing device.

The invention also relates to a hearing device system, which comprises a left and a right hearing device unit, which is characterized in that the hearing device units each comprise an inventive identification element of the above-described type.

The hearing device unit of the bearing device system can preferably be programmed, with it being particularly preferred that information for programming can be transmitted in a wireless fashion to the hearing device units.

BRIEF DESCRIPTION OF THE DRAWINGS

Further characteristics, features and advantages of the present invention are described with reference to the following exemplary embodiment in conjunction with the appended drawings, in which.

DETAILED DESCRIPTION OF THE INVENTION

Figure 1:
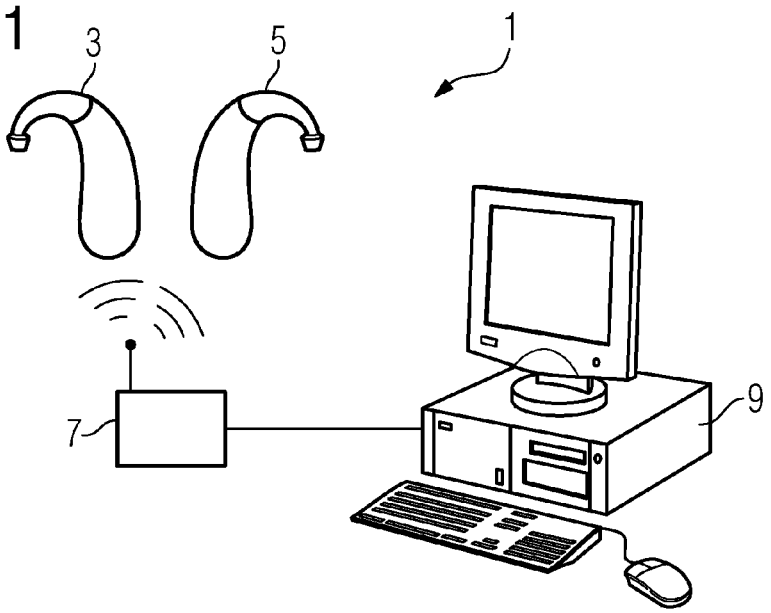
FIG. 1 shows a schematic representation of a hearing device system according to the invention with a programming facility.

FIG. 1 shows a hearing device system 1 according to the invention with a left and a right behind-the-ear hearing device unit 3 and/or 5, which can be programmed wirelessly by a programming device 7 which is connected to a computer 9, and information for programming the right behind-the-ear hearing device unit 3 and/or 5 can be wirelessly transmitted to the hearing units.

The hearing device acoustician can program the hearing device system 1 in a wireless fashion by way of the computer 9 and the programming device 7. The hearing device system 1 and/or the hearing device units 3 and 5 comprise a signal processing, and can be individually adjusted to the requirements of a hearing device wearer, with the left bearing device unit 3 and the right hearing device unit 5 being able to be individually adjusted in a different manner. To this end, it is necessary for a function as a left and/or right hearing device unit to be assigned to the respective hearing device unit 3 and/or 5, so that the respective left or right hearing device unit can be specifically detected and addressed during the programming. This enables the hearing device acoustician to assign specific further functions and adjustments, which are matched to the left and/or right ear of a hearing device wearer, to the left or right hearing device unit.

Figure 2:
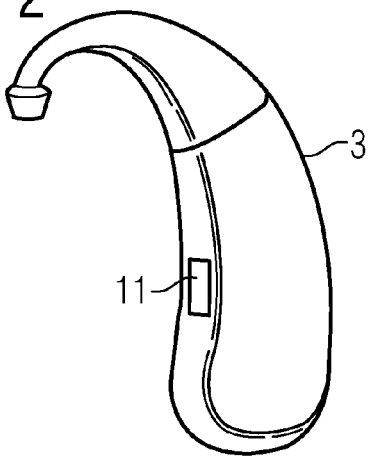
FIG. 2 shows a perspective view of a hearing device unit with an identification element according to the invention.

Reference is made to FIG. 2. To enable a distinction to be made between the left hearing device unit 3 and the right hearing device unit 5 externally, it bears an identification element 11 which is visible from the outside. The identification element 11 can be a colored plaque, which simultaneously functions as a name plate. In this process, the left and right sides can be coded with different colors, e.g. blue for the left and red for the right. Other coding possibilities of the identification element are likewise conceivable, e.g. it can be marked with the letter "L" or "R".

Figure 3:
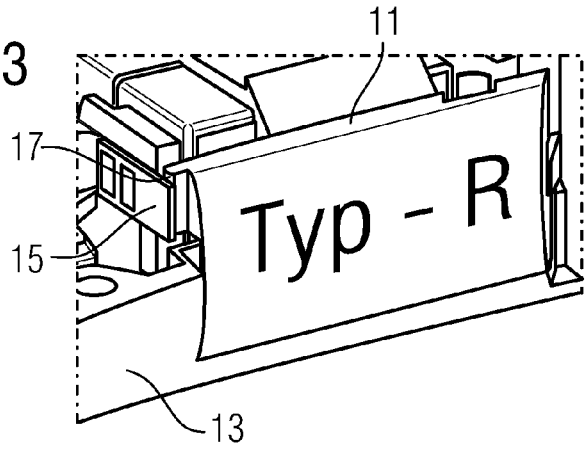
FIG. 3 shows a partially intersected partial view of a hearing device unit with an identification element according to the invention.

Reference is made to FIG. 3. To also enable a signal-specific useable distinction, in addition to the optical distinction, the identification element 11, which is inserted into a housing element 13 of the hearing device unit, is in contact with a printed circuit board 15 of the signal processing facility, on which the conductor paths are located. In this way, the contact surface 17 of the identification element 11, which is in contact with the printed circuit board 15, can optionally be coated and/or not coated in an electrically conductive manner, in order to electrically connect and/or electrically insulate conductor paths on the printed circuit board 15 in an electrical connection and/or with an electrical insulation. Accordingly, the signal processing facility of the hearing device unit makes available signal-specific useable information, by virtue of the electrically connected conductor paths, and/or the electrically insulated conductor paths, with which a function as a left and/or right hearing device unit is assigned to the signal processing.

The contact surface 17 of the identification element 11 can be embodied as a guide lug. A recess for the identification element 11 is provided in the housing element 13, which can be inserted into the recess. During insertion into the housing element, the guide lug impacts the contact surface 17 on the flexibly configured printed circuit board 15. The contact surface 17 can be coated with a conductive varnish for instance or with a gilding, in order to close an electrical connection between the two conductor paths on the printed circuit board, or not, depending on which of the two hearing device units are concerned.

The exemplary embodiment according to the invention is only exemplary and illustrative. Many variations can be conceived in respect of the identification element and the means comprised therein for assigning as a function as a left or right hearing device unit, which are suited to transmitting information relating to whether the hearing device unit concerns the left or right hearing device unit. Purely mechanical or magnetic elements are also conceivable for instance, which contain the corresponding information by means of a suitable interaction with the signal processing facility in the hearing device unit.

The invention claimed is:

1. An identification element for a hearing device unit of a hearing device system comprising a left hearing device unit and a right hearing device unit, comprising:

an assigning device that assigns a respective function as the left or the right hearing device unit to a signal processing unit of the hearing device unit, wherein the left and the right hearing device units are wirelessly programmed by a programming device connected to a computer, wherein the programming device detects the assigned respective function as the respective left or the right hearing device unit and programs the respective left or the right hearing device unit individually and differently based on the assigned respective function so that the left or the right hearing device unit can be individually adjusted to match a requirement of a left or a right ear of a hearing device system wearer, wherein information for programming the respective left and the right hearing device units is wirelessly transmitted to the left and the right hearing device units, and wherein the identification element visibly identifies the hearing device unit as the left or the right hearing device unit from an outside of the left or the right hearing device unit.

2. The identification element as claimed in claim 1, wherein the assigning device is selected from the group consisting of: an electrical assigning device, a mechanical assigning device, and a magnetic assigning device.

3. The identification element as claimed in claim 1, wherein the assigning device comprises an electro technical component.

4. The identification element as claimed in claim 1, wherein the assigning device is a contact surface of the identification element that contacts with a printed circuit board of the hearing device unit.

5. A hearing device system, comprising:

a left hearing device unit;

a left identification element arranged on the left hearing device unit that visibly identifies the left hearing device unit from an outside of the left hearing device unit;

a left assigning device arranged on the left identification element that assigns a respective function as the left hearing device unit to a signal processing unit of the left hearing device unit;

a right hearing device unit;

a right identification element arranged on the right hearing device unit that visibly identifies the right hearing device unit from an outside of the right hearing device unit; and a right assigning device arranged on the right identification element that assigns a respective function as the right hearing device unit to a signal processing unit of the right hearing device unit, wherein the left and the right hearing device units are wirelessly programmed by a programming device connected to a computer, wherein the programming device detects the assigned respective function as the respective left or the right hearing device unit and programs the respective left or the right hearing device unit individually and differently based on the assigned respective function so that the left or the right hearing device unit can be individually adjusted to match a requirement of a left or a right ear of a hearing device system wearer, wherein information for programming the left and the right hearing device units is wirelessly transmitted to the left and the right hearing device units, and wherein the identification element visibly identifies the hearing device unit as the left or the right hearing device unit from an outside of the left or the right hearing device unit.

* * * * *